US007083464B2

(12) United States Patent
Liu et al.

(10) Patent No.: US 7,083,464 B2
(45) Date of Patent: Aug. 1, 2006

(54) ELECTRICAL CONNECTOR FOR FFC OR FPC

(75) Inventors: Xing-Liang Liu, Kunsan (CN); Ke-Zhi Li, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/137,892

(22) Filed: May 25, 2005

(65) Prior Publication Data

US 2006/0046560 A1 Mar. 2, 2006

(30) Foreign Application Priority Data

Aug. 27, 2004 (CN) ..... 2004 2 00791315

(51) Int. Cl.
*H01R 12/24* (2006.01)

(52) U.S. Cl. ..... 439/495; 439/260

(58) Field of Classification Search ..... 439/260, 439/495, 496–499, 259, 331
See application file for complete search history.

(56) References Cited

U.S. PATENT DOCUMENTS

| | | | | |
|---|---|---|---|---|
| 5,476,393 | A | 12/1995 | Narita | |
| 6,338,648 | B1 * | 1/2002 | Miura et al. | 439/495 |
| 6,524,124 | B1 * | 2/2003 | Yamane | 439/260 |
| 6,533,606 | B1 * | 3/2003 | Yamane | 439/495 |
| 6,761,573 | B1 * | 7/2004 | Chiu | 439/260 |
| 6,902,425 | B1 * | 6/2005 | Huang | 439/495 |
| 2004/0248447 | A1 * | 12/2004 | Aoki | 439/260 |

FOREIGN PATENT DOCUMENTS

| | | |
|---|---|---|
| TW | 591830 | 6/2004 |

* cited by examiner

*Primary Examiner*—James R. Harvey
(74) *Attorney, Agent, or Firm*—Wei Te Chung

(57) ABSTRACT

An electrical connector (1) comprises a housing (11), a plurality of electrical contacts (12) retained in the housing (11), a cover member (13) pivotally assembled to the housing (11) and an actuator (14) mounted in one side of the housing (11). The actuator (14) includes a base (141), a retaining arm (142) extending from an end of the base (141), a spring arm (145) extending from the other end of the base (141), and a cooperator (144) curving laterally from a distal end of the spring arm (145), thereby forming a first face (1441). The cover member (13) consists of a securing portions (133) defined at an end of one side thereof and has a plane (1331). In using, the first face (1441) engages with the plane (1331) so as to protect the cover member (13) from overturning.

13 Claims, 4 Drawing Sheets

ELECTRICAL CONNECTOR FOR FFC OR FPC

BACKGROUND OF THE INVENTION

1. Field of the Invention

The present invention generally relates to a connector for connecting, e.g., a flexible flat cable (FFC), a flexible printed circuit or cable (FPC), and in particular to a connector which prevents a cover member from overturning.

2. Description of Related Art

A general connector for connecting a flexible flat cable (FFC), or a flexible printed circuits or cable (FPC), as disclosed in U.S. Pat. No. 5,476,393 and Taiwan patent issue No. 591830, comprises a housing, a plurality of conductive contacts retained in the housing and a cover member pivotally assembled to the housing. The housing includes a body member, a plurality of receiving channels retaining conductive contacts and a pair of receiving portions located in two inner sides of the body member. Further, the cover member has a base portion and a pair of pivots formed at two longitudinal ends of one side of the base portion.

In assembly, at first, the plurality of conductive contacts is accommodated in the plurality of receiving channels, then, the pair of pivots of the cover member are attached to the pair of receiving portions of the body member. In using, firstly, turning on the cover member to perpendicular to the body member so as to put an FFC into an opening (not shown) defined in the housing, Fly, turning out the cover member to press the FFC against the plurality of conductive contacts to achieve the electrical connection between the connector and the FFC.

However, for the conjugation between the cover member and the housing is due to the pair of pivots, especially for the pair of pivots is formed at one side of the base portion while the other side is in freedom, the cover member may overturn relatively to the housing under outside force, thus, the pressure to the FFC by the connector is unfavorable to achieve the reliably electrical connection between them. Otherwise, the configuration of the connector in U.S. Pat. No. 5,476,393 is complex so the cost is high.

SUMMARY OF THE INVENTION

Accordingly, an objection of the present invention is to provide an electrical connector comprising means to prevent the cover member from overturning.

In order to achieve the objection set forth, an electrical connector in accordance with the present invention comprises a housing, a plurality of electrical contacts retained in the housing, a cover member pivotally assembled to the housing and an actuator mounted in one side of the housing. The actuator separated from or integrally molding with the cover member includes a base, a retaining arm extending from an end of the base, a spring arm extending from the other end of the base, and a cooperator curving laterally from a distal end of the spring arm, thereby forming a first face. Furthermore, the cover member consists of a securing portion defined at an end of one side of the base portion and has a plane. In using, the first face engages with the plane so as to protect the cover member from overturning.

Other objects, advantages and novel features of the present invention will become more apparent from the following detailed description of the present embodiment when taken in conjunction with the accompanying drawings.

DETAILED DESCRIPTION OF THE INVENTION

Figure 1:
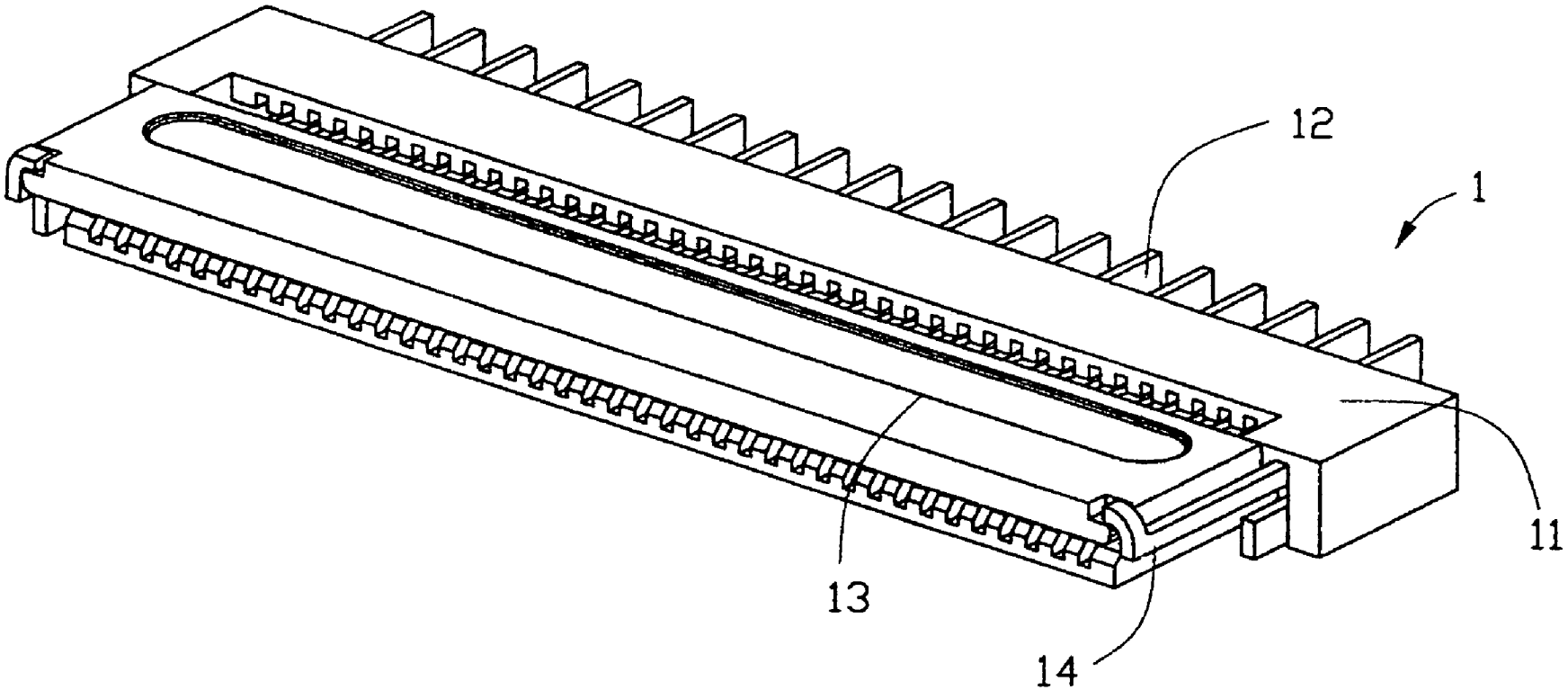
FIG. 1 is a perspective assembly view of an electrical connector in accordance with the present invention.

Referring to FIG. 1, a connector 1 in accordance with the present invention comprises a housing 11, a plurality of electrical contacts 12 retained in the housing 11, a cover member 13 pivotally assembled to the housing 11 and a pair of actuators 14 mounted in two sides of the housing 11.

Figure 2:
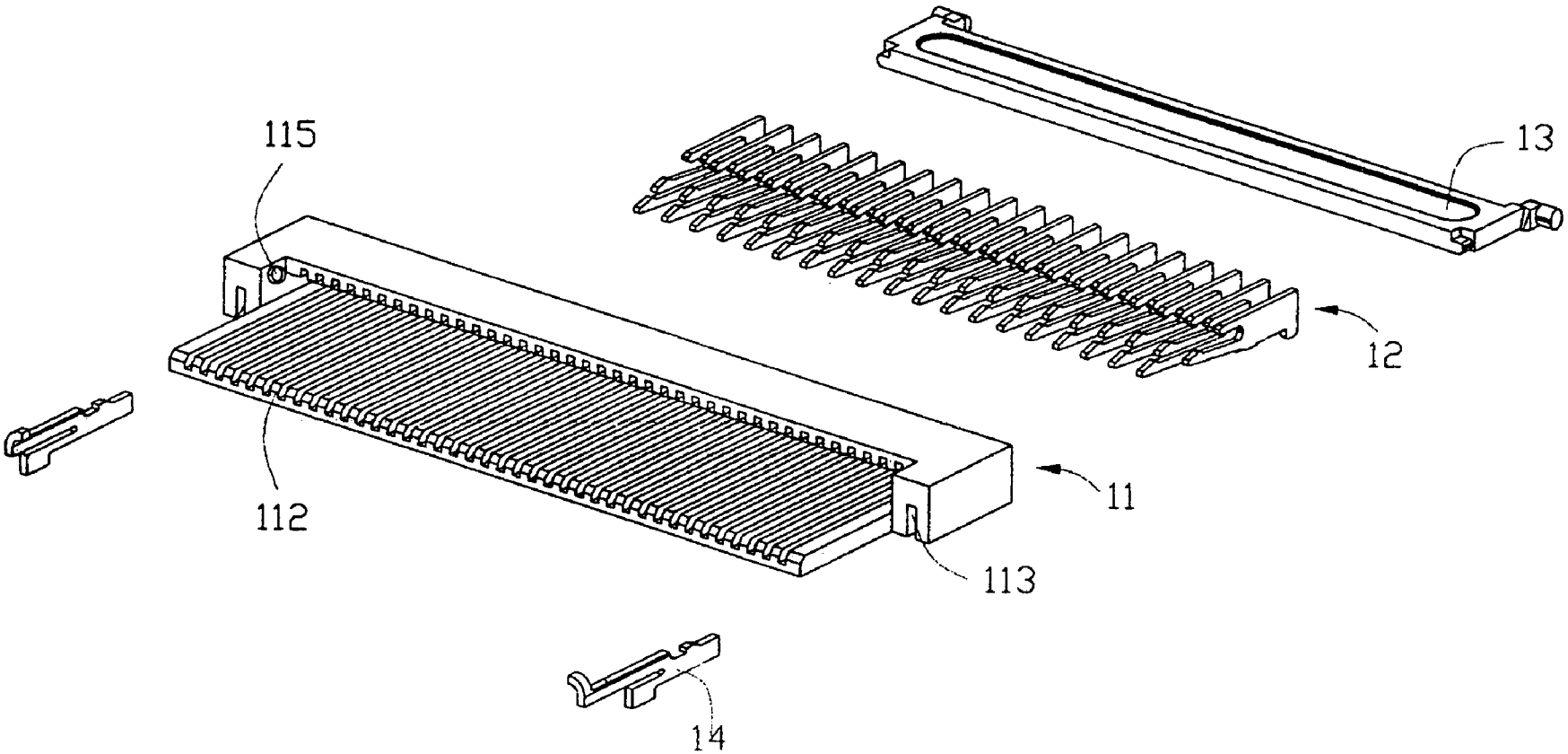
FIG. 2 is a perspective exploded view of the connector.

As shown in FIG. 2, the housing 11 includes a plurality of receiving channels 112 retaining conductive contacts 12, a pair of receiving portions 115 defined in two inner sides thereof, and a pair of fixing grooves 113 (not if the actuator 14 integrally molding with the housing 11) located in two sides thereof. A securing groove (not shown) is defined in the fixing groove 113.

Figure 3:
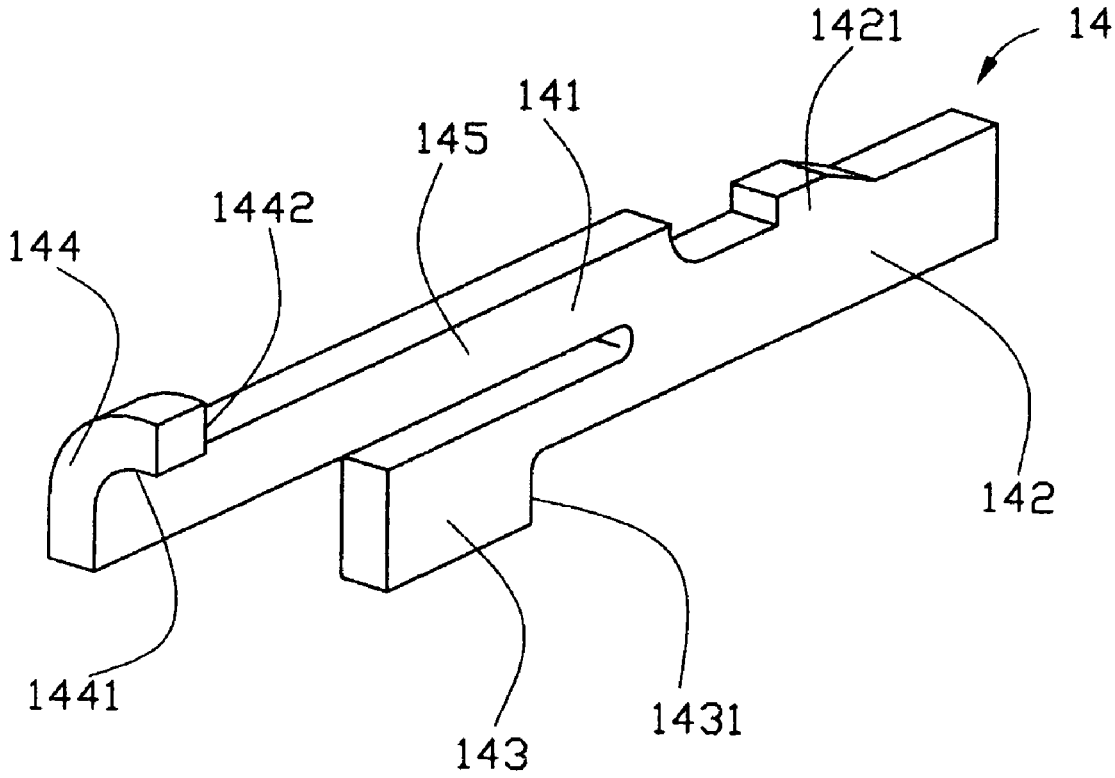
FIG. 3 is a perspective view of an actuator of the connector.

Referring to FIG. 3, the actuator 14 separated from or integrally molding with the housing 11 includes a base 141, a retaining arm 142 extending from an end of the base 141 received into the fixing groove 113 of the housing 11 comprising a projection 1421 matching the securing groove (not shown), a spring arm 145 extending from the other end of the base 141, a cooperator 144 curving laterally from a distal end of the spring arm 145 and defining a fist face 1441 in transverse and a second face 1442 close and perpendicular to the first face 1441, and a soldering portion 143 extending from the same end of the base 141 as the spring arm 145. Furthermore, the spring arm 145 is parallel to the soldering portion 143 and there is a clearance between them, so the spring arm 145 is defined as a cantilever. The soldering portion 143 is weld onto the printed circuit board in order to mount the connector onto the printed circuit board.

Figure 4:
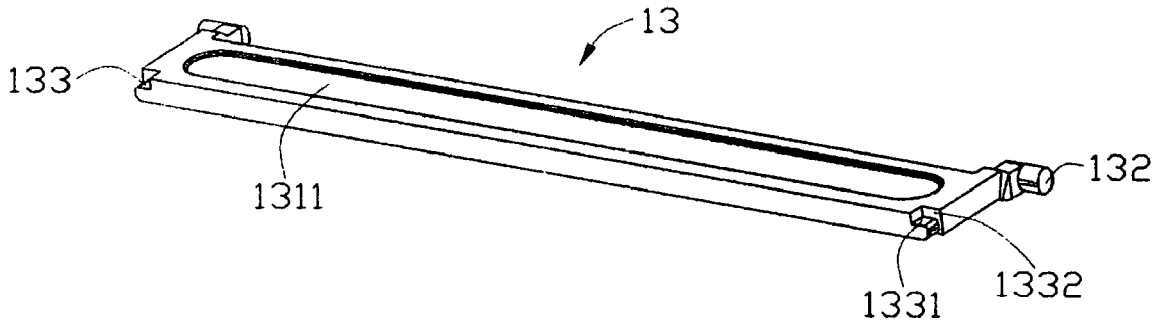
FIG. 4 is a perspective view of a cover member of the connector.

With further reference to FIG. 4, the cover member 13 made of high intensive material such as dielectric stainless steel has a pair of pivots 132 formed at two longitudinal ends of one side thereof and a securing portions 133 providing a plane 1331 in horizontal and a third face 1332 close and perpendicular to the plane 1331 defined at an end of an opposite side thereof. Each pivot 132 is assembled into the receiving portion 115 of the housing 11. Otherwise, a flute 1311 is defined on the cover member 13 for the convenience of rotating the cover member 13.

In assembly, firstly, the plurality of conductive contacts 12 is accommodated in the plurality of receiving channels 112, Firstly, the actuator 14 is inserted into the fixing groove 113, especially the projection 1421 matches the securing groove to prevent the actuator from shifting, lastly, the pair of pivots 132 of the cover member 13 are received into the pair of receiving portions 115 of the housing 11. In using, at first, turning on the cover member 13 to perpendicular to the body member 111 so as to put a flat flexible cable (FFC) (not shown) into an opening (not shown) defined in the housing 11, then, rotating the cover member 13 to press the FFC against the plurality of conductive contacts 12, keeping on rotating the cover member 13 to crush the cooperator 144 of the actuator 14, at the effect of the spring arm 145, the cooperator 144 outspread respectively to the outsides of the connector 1, lastly, the cover member 13 is being rotated in level, simultaneously, at the effect of the spring arm 145, the cooperator 144 resume to its locality. At this time, the first face 1441 engages with the plane 1331 and the second face 1442 engages with the third face 1332 so as to protect the cover member 13 from overturning to achieve the electrical connection between the connector 1 and the FFC. Understandably, the spring arm 145 may be optionally further equipped with a handle around the distal end for outwardly deflecting the spring arm 145 to easily release the plane 1331 of the cover 13 from the cooperator 144 of the actuator 14 for moving the cover 13 and loading/unloading the FPC unto/from the housing 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing defining a plurality of receiving channels and a fixing groove in one side thereof;

a plurality of electrical contacts retained in the receiving channels;

a cover member pivotally assembled to the housing and comprising a securing portion defined at an end of one side thereof; and an actuator comprising a retaining arm received in said fixing groove, and a spring arm extending from the retaining arm and comprising a cooperator engageable with said securing portion, wherein the spring arm is laterally deflectable, when assembled;

wherein the actuator defines a soldering portion; and wherein the spring arm is parallel to the soldering portion and defines a clearance therebetween.

2. The connector as described in claim 1, wherein the cooperator curves laterally from a distal end of the spring arm.

3. The connector as described in claim 1, wherein the securing portion includes a recess engaging with said cooperator.

4. The connector as described in claim 1, wherein the retaining arm includes a projection secured in the fixing groove.

5. The connector as described in claim 1, wherein the cover member defines a flute on an upper surface thereof.

6. The connector as described in claim 1, wherein the cover member comprises a pair of pivots formed at two longitudinal ends of an opposite side thereof and assembled to a pair of receiving portions defined in two inner sides of the housing.

7. An electrical connector for a flexible flat cable or flexible printed circuit or cable comprising:

a housing defining a plurality of receiving channels;

a plurality of electrical contacts retained in the receiving channels;

a cover member pivotally assembled to the housing and comprising a securing portion defined at an end of one side thereof; and an actuator comprising a retaining arm secured in the housing and a spring arm extending from the retaining arm to the outside of the housing as a cantilever and deflectably engageable with said securing portion;

wherein the actuator defines a soldering portion; and wherein the spring arm is parallel to the soldering portion and defines a clearance therebetween.

8. The connector as described in claim 7, wherein the spring arm has a cooperator curving laterally therefrom, and wherein the securing portion defines a recess engaging with said cooperator.

9. The connector as described in claim 7, wherein the cover member defines a flute on an upper surface thereof.

10. The connector as described in claim 7, wherein the actuator defines a soldering portion.

11. The connector as described in claim 7, wherein the cover member comprises a pair of pivots formed at two longitudinal ends of an opposite side thereof and assembled to a pair of receiving portions defined in two inner sides of the housing.

12. An electrical connector comprising:

a housing defining a plurality of receiving channels therein and a longitudinal direction thereof;

a plurality of electrical contacts retained in the receiving channels, respectively;

a cover member essentially rotatably assembled to the housing and comprising a securing portion at a longitudinal end along said longitudinal direction; and an actuator located on one longitudinal end of the housing and comprising a retaining arm having one portion secured to the housing, and a deflectable spring arm comprising a cooperator engageable with said securing portion to prevent said cover from backward rotation when said cover is completely assembled to the housing;

wherein the actuator defines a soldering portion; and wherein the spring arm is parallel to the soldering portion and defines a clearance therebetween.

13. The connector as described in claim 12, wherein the cooperator curves laterally from the spring arm, and wherein the securing portion defines a recess engaging with said cooperator.

* * * * *